US006194820B1

(12) United States Patent
Machida

(10) Patent No.: US 6,194,820 B1
(45) Date of Patent: Feb. 27, 2001

(54) DISCHARGE TUBE HAVING SWITCHING SPARK GAP

(75) Inventor: Kazuhiko Machida, Nagano (JP)

(73) Assignee: Shinko Electric Industries Co., Ltd., Nagano (JP)

( * ) Notice: Subject to any disclaimer, the term of this patent is extended or adjusted under 35 U.S.C. 154(b) by 0 days.

(21) Appl. No.: 09/251,528

(22) Filed: Feb. 17, 1999

(30) Foreign Application Priority Data

Feb. 20, 1998 (JP) ..... 10-038646

(51) Int. Cl.[7] ..... H01J 17/26; H01J 61/28
(52) U.S. Cl. ..... 313/231.11; 361/120
(58) Field of Search ..... 313/231.11, 345, 313/346 R, 574, 589, 622, 637; 361/120

(56) References Cited

U.S. PATENT DOCUMENTS 4,665,337 * 5/1987 Watzke et al. ..... 313/231.11
4,924,347 * 5/1990 Cantargel ..... 361/120
5,892,648 * 4/1999 Bobert et al. ..... 361/120

FOREIGN PATENT DOCUMENTS 0 769 832 4/1997 (EP) .
8-506449 7/1996 (JP) .

* cited by examiner

*Primary Examiner*—Frank G. Font
*Assistant Examiner*—Layla G. Lauchman
(74) *Attorney, Agent, or Firm*—Pennie & Edmonds LLP

(57) ABSTRACT

A discharge tube can continuously discharge at intervals of 2.5 ms in stable fashion in a high-temperature environment at 150° C. A discharge tube 10 comprises a pair of electrodes 14*a*, 14*b* with the discharge surfaces 16, 16 thereof disposed opposite to each other in a space portion 22 filled with a sealing gas. Each discharge surface 16 of the electrode pair 14*a*, 14*b* is formed with an insulating layer 18 composed of an insulating material mixed with potassium bromide and nickel bromide.

7 Claims, 8 Drawing Sheets

DISCHARGE TUBE HAVING SWITCHING SPARK GAP

BACKGROUND OF THE INVENTION

1. Field of the Invention

The present invention relates to a discharge tube, or more in particular, to a discharge tube comprising at least a pair of electrodes with the discharge surfaces thereof arranged in opposition to each other in a space filled with a sealing gas.

2. Description of the Related Art

The lighting circuit of a gas discharge lamp such as a metal halide lamp or a xenon lamp used as a high-voltage lamp includes a discharge tube as shown in FIG. 5 or 6 (a switching spark gap, hereinafter sometimes referred to as "SSG") for supplying the operating voltage to the lamp to be turned on.

The SSG 10 shown in FIG. 5 includes a cylindrical member 12 made of an insulating material such as a ceramic, and a pair of electrodes 14*a*, 14*b* arranged with discharge surfaces 16, 16 thereof inserted in a space portion 22 by way of the openings at the two ends of the cylindrical member 12. The discharge surfaces 16, 16 are arranged in opposition relation to each other through a sealing gas filled in the space portion 22. The flat portions of the discharge surfaces 16, 16 are coated with insulating layers 18, 18, respectively, of an insulating material.

The SSG 10 shown in FIG. 6 has a substantially similar structure to the SSG shown in FIG. 5, except that recesses 20, 20 are formed in the discharge surfaces of a pair of the electrodes 14*a*, 14*b*. The surfaces of the recesses 20, 20 are coated with an insulating material thereby to form insulating layers 18, 18, respectively. The area of the discharge surface can be enlarged and the service life of the discharge tube can be lengthened by forming the recesses 20, 20 in the discharge surfaces in this way.

In the case where the SSG 10 shown in FIGS. 5 and 6 is to be discharged continually, it is necessary to supply a specific operating voltage at a frequency of several ms to several tens of ms in stable fashion to the lamp, etc. For this purpose, JP-A-9-22769 proposes a SSG in which a pair of the insulating layers 18, 18 formed on the discharge surfaces 16, 16 of a pair of the electrodes 14*a*, 14*b* are formed of an insulating material mixed with at least an alkali metal salt selected from potassium bromide, potassium fluoride and sodium fluoride.

When the SSG proposed in the aforementioned patent publication is discharged continually at intervals of 200 Hz (5.0 ms) in frequency, as shown in FIG. 7, a predetermined operating voltage can be supplied in a stable fashion. The SSG exhibiting the discharge characteristic of FIG. 7 is the SSG 10 shown in FIG. 5 having the insulating layers 18 mixed with potassium bromide. The potassium bromide thus added represents 15% by weight of the water glass solution forming the insulating layers 18. This potassium bromide is dissolved in the water glass contained in the insulating material and coated on the discharge surfaces 16, 16 of the electrode pair 14*a*, 14*b*.

In FIG. 7, point A represents a discharge start voltage, which is set to 1000 V in this case.

In recent years, gas discharge lamps such as metal halide lamps or xenon lamps have been employed for home-use projectors or TVs or for headlights of automobiles. The SSG is used for the lighting circuit of such lamps. For automotive applications, the SSG is often installed in the engine compartment.

For this reason, demand is high for a SSG which can discharge in stable fashion even when discharged continually at intervals of 400 Hz (2.5 ms) in a high-temperature (150° C.) environment.

In the case where the SSG 10 formed with an insulating layer 18 made of potassium bromide, representing 15% by weight of a water glass solution, is discharged continually at intervals of 2.5 ms at room temperature, however, the discharge is often suspended midway as shown in FIG. 8.

Also in the case where the SSG 10 is continually discharged at intervals of 200 Hz (5.0 ms), it has been found that when the ambient temperature of the SSG 10 is increased to 150° C., the discharge start voltage is liable to become unstable as shown in FIG. 9.

SUMMARY OF THE INVENTION

Accordingly, the object of the present invention is to provide a SSG which can be continually discharged in a stable fashion at intervals of 2.5 ms in a high-temperature (150° C.) environment.

The present inventor, after studying this problem, has attained this invention by finding that a stable continuous discharge at intervals of 2.5 ms is possible when the insulating layers 18, 18 formed on the discharge surfaces 16, 16 of a pair of the electrodes 14*a*, 14*b* making up the SSG 10 are mixed with potassium bromide and nickel bromide.

Specifically, according to this invention, there is provided a discharge tube comprising at least a pair of electrodes with the discharge surfaces thereof arranged in opposition to each other in a space portion filled with a sealing gas, wherein an insulating material composed of a mixture of potassium bromide and nickel bromide is coated on the discharge surfaces of the electrode pair thereby to form insulating layers.

The discharge tube (SSG) according to this invention can discharge continually in stable fashion at intervals of 2.5 ms. This is possible even in a high-temperature (150° C.) environment.

The discharge tube (SSG) according to this invention, which can discharge stably even when mounted in the engine compartment of an automotive vehicle where the ambient temperature becomes high, is suitably applicable as a SSG for vehicles.

BRIEF DESCRIPTION OF THE DRAWINGS

The above and other objects, features and advantages will be made apparent by the detailed description taken in conjunction with the accompanying drawings, in which.

DESCRIPTION OF THE PREFERRED EMBODIMENTS

Figure 5:
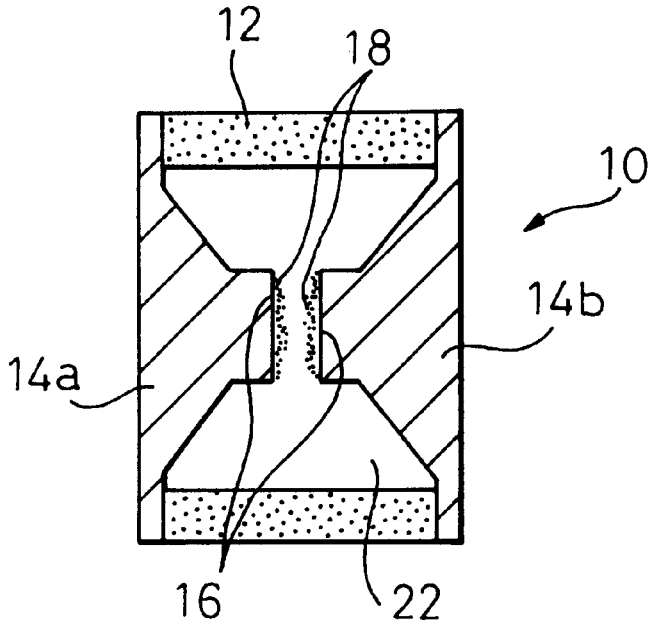
FIG. 5 is a sectional view showing an example of the discharge tube according to this invention.
Figure 6:
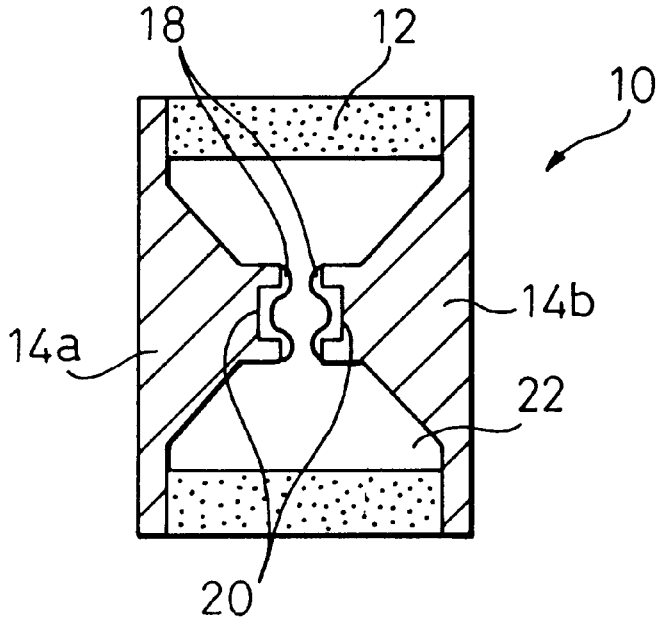
FIG. 6 is a sectional view showing another discharge tube according to this invention.
Figure 7:
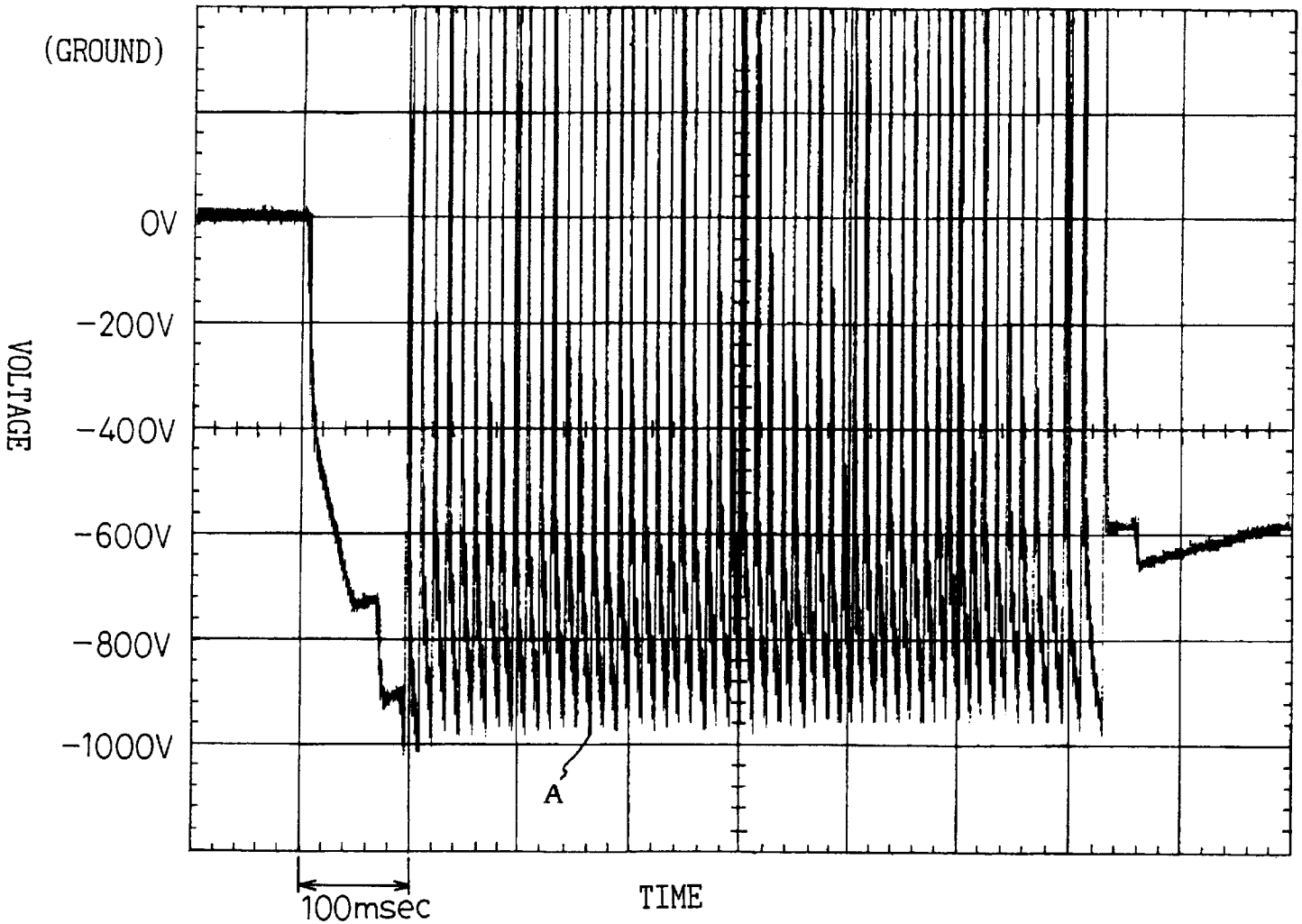
FIG. 7 is a chart showing the discharge characteristic of a discharge tube comprising insulating layers mixed with potassium bromide alone according to the present invention continually discharged at intervals of 200 Hz (5 ms) in frequency.
Figure 8:
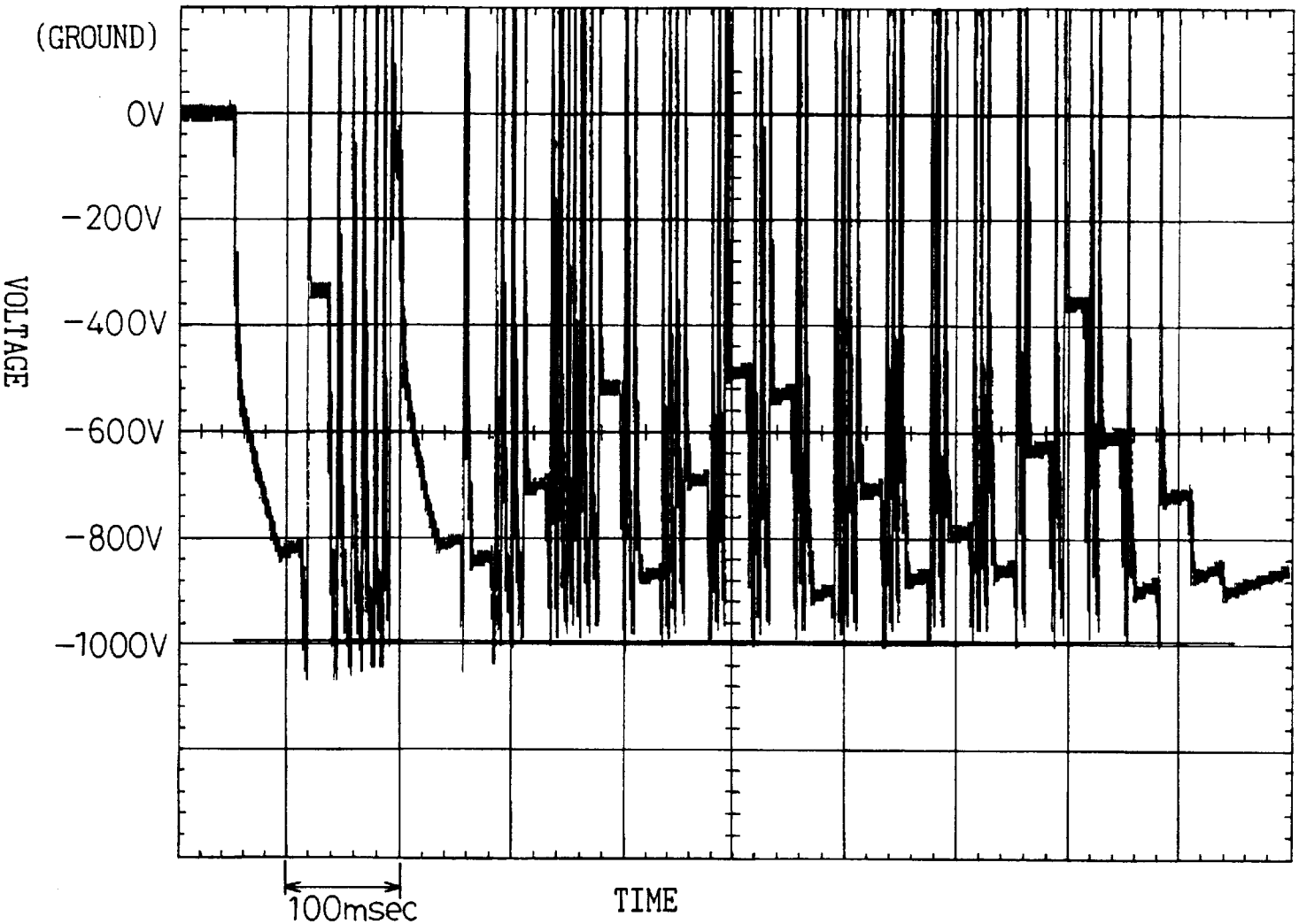
FIG. 8 is a chart showing the discharge characteristic of a discharge tube comprising insulating layers mixed with potassium bromide alone according to the present invention continually discharged at intervals of 400 Hz (2.5 ms) in frequency.
Figure 9:
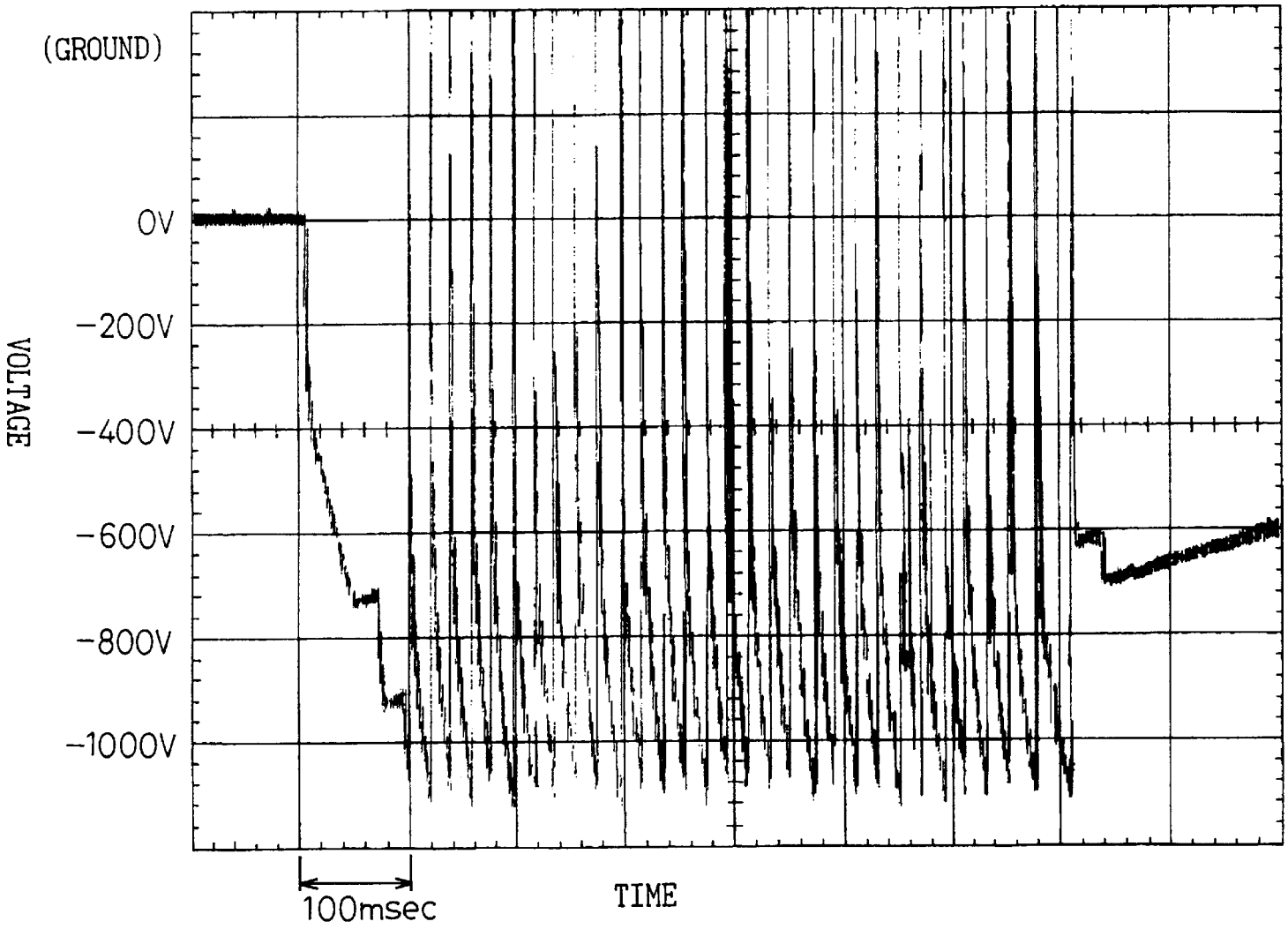
FIG. 9 is a chart showing the discharge characteristic of a discharge tube comprising insulating layers mixed with potassium bromide alone according to the present invention continually discharged at intervals of 200 Hz (5 ms) in frequency in an environment at 150° C.

The discharge tube (SSG) according to this invention has the same structure as the SSG 10 shown in FIG. 5 or 6. Specifically, a pair of electrodes 14*a*, 14*b* are arranged with the discharge surfaces 16, 16 thereof in opposed relation to each other in a space portion 22 filled with a sealing gas.

With this SSG 10, it is essential that an insulating material mixed with potassium bromide and nickel bromide is coated on the discharge surfaces 16, 16 of the electrode pair 14*a*, 14*b* thereby to form insulating layers 18, 18.

The insulating layers 18, 18 is composed of a mixture of potassium bromide and nickel bromide. Such layers 18, 18 can be formed by coating a coating material composed of an insulating material containing water glass mixed with potassium bromide and nickel bromide on the discharge surfaces 16, 16.

The water glass is a thick aqueous solution of sodium silicate and contains 2 to 4 mols of $SiO_2$ per mol of $Na_2O$ and assumes a glass-like property after being dried in the air.

Preferably, the insulating material containing water glass which is mixed with potassium bromide and nickel bromide at the saturated solubility or less thereof with respect to the water glass, is coated on the discharge surfaces 16, 16. Specifically, the total amount of the mixture of potassium bromide and nickel bromide represents 1 to 67% (preferably, 1 to 30%) by weight of the water glass solution (water is used as a solvent), while nickel bromide preferably represents 0.5% to 10% (more preferably 2%) by weight of the water glass solution, and potassium bromide represents the remainder.

In the case where the total amount of the mixture of potassium bromide and nickel bromide exceeds 67% by weight of the water glass solution, or in the case where potassium bromide exceeds 65% by weight of the water glass solution, or in the case where nickel bromide exceeds 13% by weight of the water glass solution, then the potassium bromide, or the nickel bromide, or the mixture of potassium bromide and nickel bromide against the water glass, exceeds the saturated solubility so that a substance may remain undissolved in the coating material, thereby often making it difficult to obtain a uniform coating material.

In the case where the total amount of the mixture of potassium bromide and nickel bromide is less than 1% by weight of the water glass solution or in the case where the amount of potassium bromide or nickel bromide is less than 0.5% by weight of the water glass solution, then it is often difficult to obtain a SSG which can discharge continually in stable fashion at the frequency of 400 Hz (2.5 ms) in a high-temperature environment of 150° C.

The insulating material may be mixed with barium titanate as in the prior art.

The discharge tube (SSG) according to this invention is fabricated in such a manner that a coating material comprising potassium bromide and nickel bromide mixed in an insulating material containing water glass is coated on discharge surfaces 16, 16 of a pair of electrodes 14*a*, 14*b*, and after drying them to form insulating layers 18, 18, a pair of the electrodes 14*a*, 14*b* are inserted into the apertures at the ends of a cylindrical member 12 with the discharge surfaces 16, 16 thereof arranged in spaced opposed relation to each other in a space portion 22.

Then, the space portion 22 is filled with a sealing gas while, at the same time, sealing the ends of the apertures of the cylindrical member 12 and the ends of the electrodes 14*a*, 14*b* to each other with a brazing material.

The sealing gas preferably is a mixture of argon gas and hydrogen gas or, especially, a mixture of argon gas, neon gas and hydrogen gas.

In the case where only an inert gas such as argon is used as the sealing gas, ions which may be generated upon activation of the SSG 10 are not sufficiently deionized and a dynamic current is liable to flow. A mixture of an inert gas such as argon with hydrogen gas, on the other hand, makes it possible to sufficiently deionize the ions that may be generated upon activation of the SSG 10, and thus prevent the dynamic current, thereby making a continuous stable discharge possible.

The amount of hydrogen gas so mixed is preferably 2 to 20% by volume of the sealing gas. In the case where the amount of hydrogen gas mixed exceeds 20% by volume, the operating voltage of the SSG tends to increase. In the case where the amount of hydrogen gas mixed is less than 2% by volume, in contrast, the deionizing effect is liable to be insufficient.

In the case where a mixture gas of argon gas, neon gas and hydrogen gas is used as a sealing gas, on the other hand, the ratio between argon gas and neon gas depends on the operating voltage of the SSG.

For an operating voltage of the SSG in the range of 800 V to 2000 V, for example, it is preferable that the amount of neon gas is 1 to 70% by volume of the sealing gas, and the remainder other than hydrogen gas and neon gas is argon gas.

Also, for an operating voltage of the SSG in the range of 500 V to 800 V, or lower than that range, the amount of neon gas represents 25 to 95% by volume of the sealing gas, and the remainder after hydrogen gas and neon gas preferably constitutes argon gas.

Further, for an operating voltage of the SSG in the range of 100 V to 500 V, or lower than that range, the amount of neon gas represents 35 to 99% by volume of the sealing gas, and the remainder after hydrogen gas and neon gas preferably constitutes argon gas.

Next, the discharge characteristic of the discharge tube (SSG) according to this invention was studied. This SSG is represented by the SSG 10 having the structure shown in FIG. 5 with an operating voltage of 1000 V. The insulating layers 18, 18 formed on the discharge surfaces 16, 16 of a pair of the electrodes 14*a*, 14*b* making up this SSG 10 are formed by coating an insulating material comprising a mixture of potassium bromide and nickel bromide. The insulating material contains a 20.0% by weight, water glass solution. Barium titanate can be mixed with the water glass solution as required. Further, the total amount of the mixture of potassium bromide and nickel bromide represents 67% by weight of the insulating material, and the amount of nickel bromide mixed represents 2% by weight of the water glass solution.

Also, a mixture of argon gas, neon gas and hydrogen gas is sealed in the space portion 22. The argon gas represents 75% by volume, the neon gas 5% by volume and the hydrogen gas 20% by volume of the sealing gas.

Figure 1:
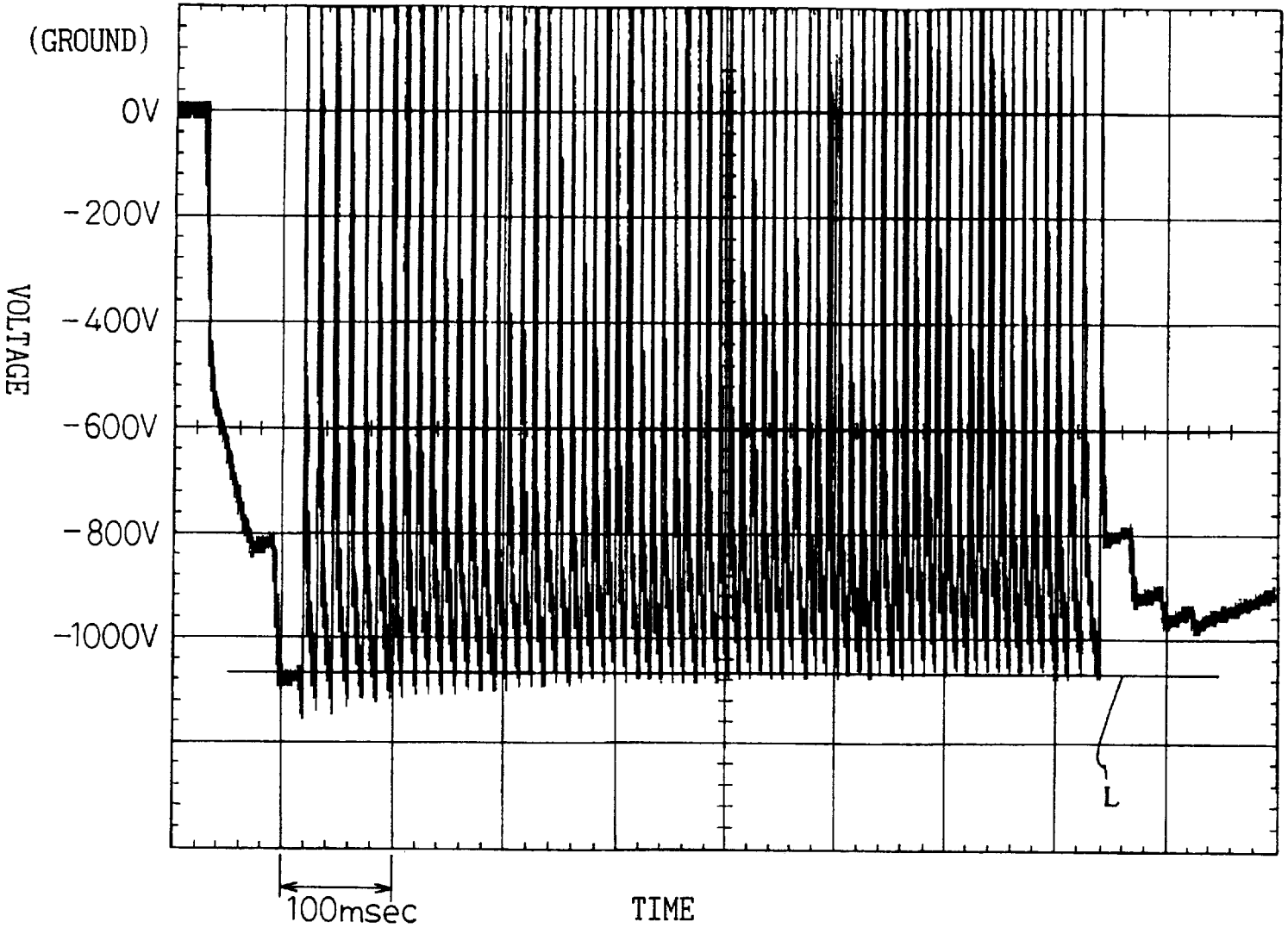
FIG. 1 is a chart showing the discharge characteristic of a discharge tube according to the present invention continually discharged at intervals of 400 Hz (2.5 ms) in frequency.

The discharge characteristic of the SSG 10 shown in FIG. 1 is obtained as a result of continually discharging the SSG 10 at intervals of 2.5 ms at room temperature. The line L in FIG. 1 represents the discharge start voltage of 1000 V.

As is clear from FIG. 1, the SSG 10 generally continually discharges in stable fashion although the discharge start voltage somewhat fluctuates immediately after the discharge starts.

Figure 2:
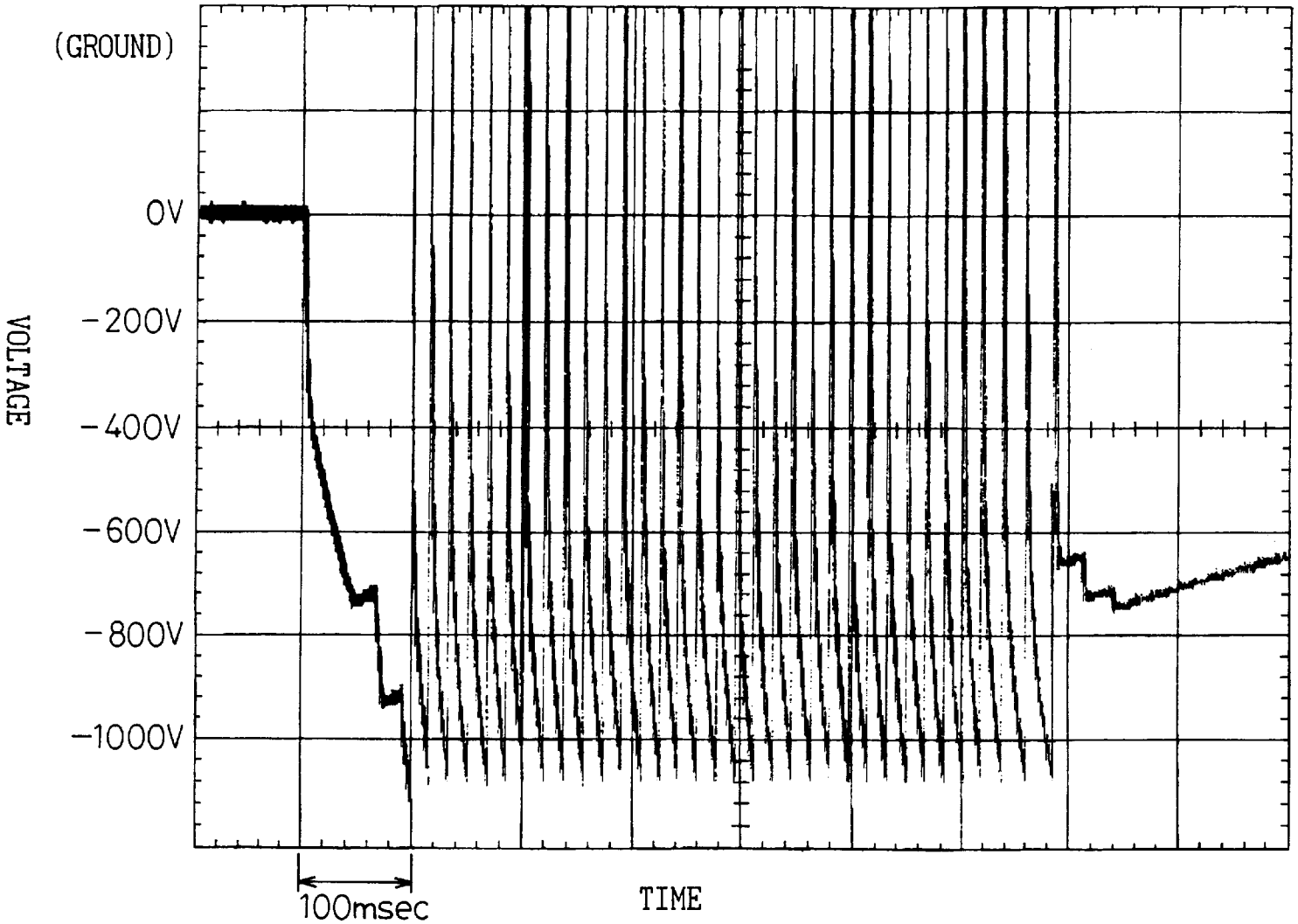
FIG. 2 is a chart showing the discharge characteristic of a discharge tube according to the present invention continually discharged at intervals of 400 Hz (2.5 ms) in frequency in an environment of 150° C.

Then, the ambient temperature of the SSG 10 is increased to 150° C. and it is continually discharged at intervals of 2.5 ms. The resulting discharge characteristic is shown in FIG. 2. As is clear from FIG. 2, the SSG 10 still continually discharges in stable fashion even in the environment increased to 150° C.

Figure 3:
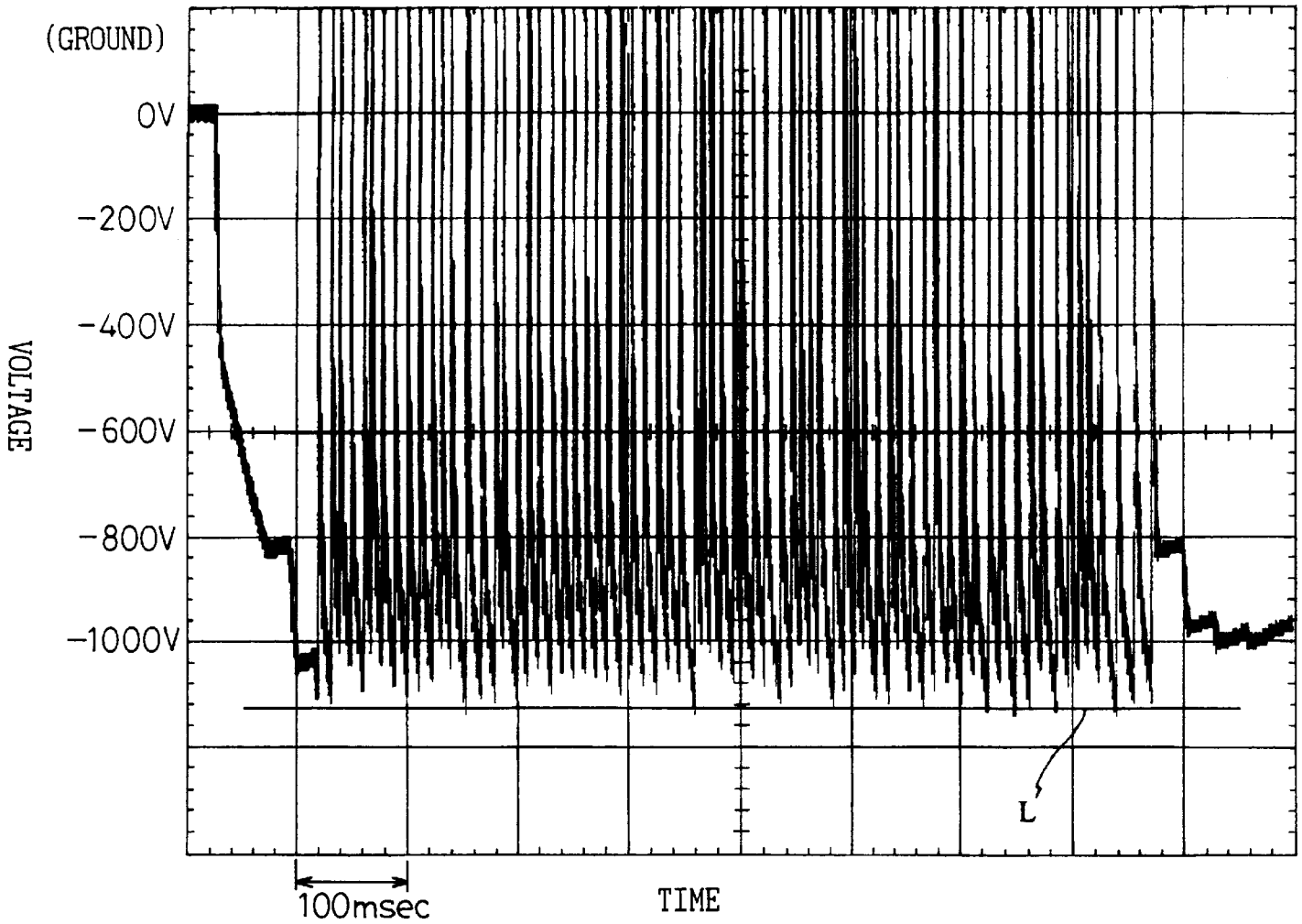
FIG. 3 is a chart, for comparison, showing the discharge characteristic of a discharge tube comprising insulating layers mixed with potassium bromide alone according to the present invention continually discharged at intervals of 400 Hz (2.5 ms) in frequency.

An SSG can be obtained, in which the SSG has the same structure as that having the discharge characteristics shown in FIGS. 1 and 2, except that only potassium bromide (but not nickel bromide) is mixed with the insulating layers 18, 18. The operating voltage of this SSG was 1000 V, and the SSG was continually discharged at intervals of 400 Hz (2.5 ms) at the room temperature. The resulting discharge characteristic is shown in FIG. 3. The line L in FIG. 3 represents the discharge start voltage of 1000 V.

As seen from FIG. 3, the SSG with only potassium bromide mixed with the insulating layers 18, 18, but not nickel bromide, fluctuates in the discharge start voltage and cannot continually discharge in stable fashion at intervals of 400 Hz (2.5 ms).

Figure 4:
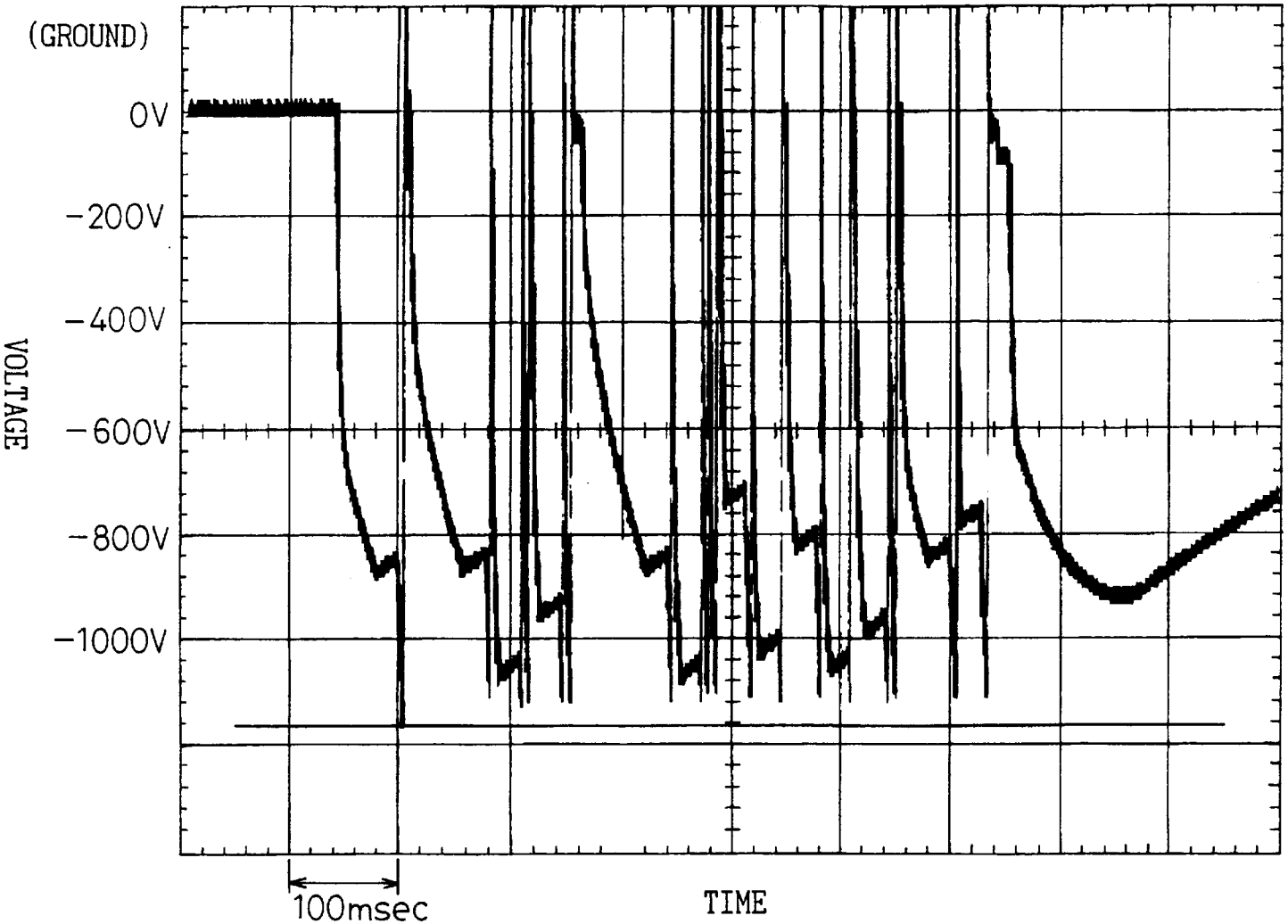
FIG. 4 is another chart, for comparison, showing the discharge characteristic of a discharge tube comprising insulating layers mixed with potassium bromide and chromium bromide ($CrBr_2$) according to the present invention continually discharged at intervals of 400 Hz (2.5 ms) in frequency.

An SSG has the same structure as the SSG 10 which exhibits the discharge characteristic of FIGS. 1 and 2 except that potassium bromide (but not nickel bromide) and chromium bromide ($CrBr_2$) are mixed with the insulating layers 18, 18. The SSG thus obtained has the operating voltage of 1000 V. This SSG was discharged continuously at intervals of 2.5 ms at room temperature. The discharge characteristic obtained is shown in FIG. 4. As is clear from FIG. 4, stable discharge cannot be continued even when chromium bromide is used instead of nickel bromide.

In the foregoing description, the insulating layers 18, 18 of the discharge tube (SSG) according to this invention contain potassium bromide and nickel bromide. Further, sodium fluoride and/or potassium fluoride can be added. Specifically, sodium fluoride and potassium fluoride are added each in the amount of 0.5 to 20% by weight (more preferably, 0.5 to 15% by weight) of the water glass solution. In addition, if required, potassium chloride and/or sodium chloride can be added to the insulating layers 18, 18.

The discharge tube (SSG) described above comprises a pair of the electrodes 14*a*, 14*b* with the discharge surfaces 16, 16 thereof arranged in opposition to each other in the space portion 22 filled with a sealing gas. Nevertheless, the invention is also applicable to the discharge tube comprising two pairs of electrodes with the discharge surfaces thereof arranged opposite to each other.

The discharge tube (SSG) according to this invention can of course be continually discharged in stable fashion at intervals of 2.5 ms or less or, for example, at intervals of 5 ms.

As described above, the discharge tube (SSG) according to this invention can continuously discharge in stable fashion at intervals of 2.5 ms. In addition, the stable discharge can be assured even in a high-temperature environment at 150° C. For this reason, the discharge tube according to the invention is suitably applied to the home-use projectors, TVs, etc. The discharge tube according to this invention is especially suitably applicable to, and can continually discharge in stable fashion in, the engine compartment of automotive vehicles where the ambient temperature becomes very high. Therefore, the discharge tube according to the invention is preferable in automotive applications.

What is claimed is:

1. A discharge tube comprising at least a pair of electrodes with the discharge surfaces thereof disposed opposite to each other in a space portion filled with a sealing gas, wherein each of said discharge surfaces of said electrode pair is coated with an insulating material mixed with potassium bromide and nickel bromide.

2. A discharge tube according to claim 1, wherein said insulating material is composed of water glass mixed with potassium bromide and nickel bromide, which are contained at not more than the saturated solubility thereof.

3. A discharge tube according to claim 1, wherein said insulating material is composed of a water glass solution with the total amount of the mixture of potassium bromide and nickel bromide representing 1 to 67% by weight of the water glass, and the ratio of said nickel bromide to said water glass solution is 0.5% to 10% by weight, the whole remainder being potassium bromide.

4. A discharge tube according to claim 1, wherein said sealing gas is a mixture of argon gas and hydrogen gas.

5. A discharge tube according to claim 1, wherein said sealing gas is a mixture of argon gas, neon gas and hydrogen gas.

6. A discharge tube according to claim 4, wherein the ratio of hydrogen gas to said sealing gas is 2 to 20% by volume.

7. A discharge tube according to claim 5, wherein the ratio of hydrogen gas to said sealing gas is 2 to 20% by volume.

* * * * *